United States Patent [19]

Liebscher et al.

[11] 4,102,000

[45] Jul. 25, 1978

[54] CARPET SWEEPER

[75] Inventors: Johannes Liebscher; Rainer Friedrich, both of Nassau, Lahn, Fed. Rep. of Germany

[73] Assignee: Leifheit International Günter Leifheit GMBH, Nassau, Lahn, Fed. Rep. of Germany

[21] Appl. No.: 768,353

[22] Filed: Feb. 14, 1977

[30] Foreign Application Priority Data

Feb. 13, 1976 [DE] Fed. Rep. of Germany ..... 2605878

[51] Int. Cl.[2] ..... A47L 11/08

[52] U.S. Cl. ..... 15/41 R

[58] Field of Search ..... 15/41–46, 15/48, 79 R, 79 A, 49 C

[56] References Cited

U.S. PATENT DOCUMENTS

| | | | |
|---|---|---|---|
| 190,982 | 5/1877 | Prindle | 15/41 R |
| 403,845 | 5/1889 | Kelley | 15/41 R |
| 498,431 | 5/1893 | Hammett | 15/41 R |
| 2,689,367 | 9/1954 | Parker | 15/79 R X |
| 3,092,862 | 6/1963 | Sherbondy | 15/79 R X |
| 3,629,892 | 12/1971 | Smyth et al. | 15/48 |

*Primary Examiner*—Edward L. Roberts
*Attorney, Agent, or Firm*—Michael J. Striker

[57] ABSTRACT

A cylindrical brush is mounted in a housing of a carpet-sweeping device for rotation about an axis extending transversely of the direction of movement of the device over the surface to be cleaned. Two dirt-collecting receptacles are located respectively at a front region of the housing and at a rear region of the housing as considered along this direction. Each dirt-collecting receptacle has an opening bounded on all sides by a plurality of walls and each receptacle is mounted for pivoting movement on the housing between a filling position in which the respective opening is located in a path in which dirt from the surface being swept travels into the receptacle, and a discharging position in which the opening is located out of the path so as to permit discharging of any deposited dirt from the receptacle. Each receptacle is lockable in its filling position, and each receptacle has top, bottom and rear walls which overlie open top, bottom, and end regions of recesses provided in the housing when a respective receptacle is locked in its filling position. An inclined guide wall may be provided at the opening for guiding the dirt from the brush into the receptacle.

15 Claims, 2 Drawing Figures

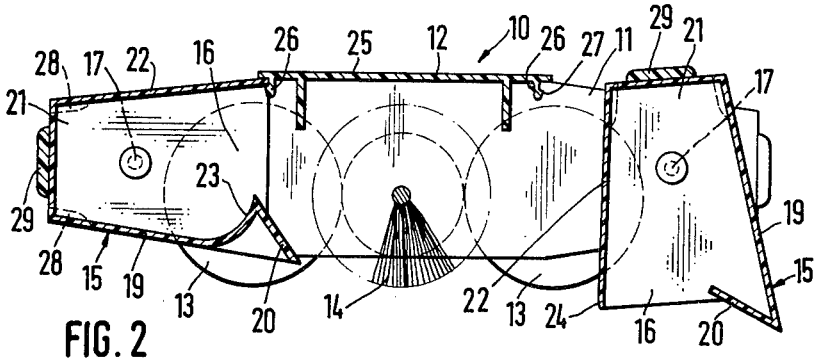
FIG. 2
FIG. 1
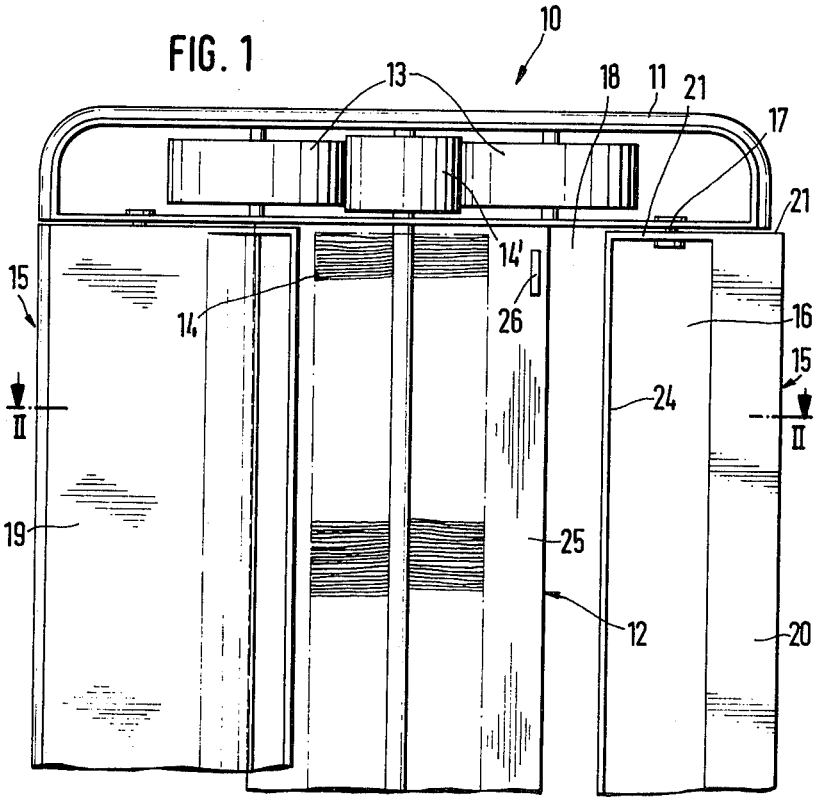

CARPET SWEEPER

BACKGROUND OF THE INVENTION

The present invention relates to a device for sweeping surfaces, particularly carpets and the like.

Carpet-sweeping and similar devices are already known and usually they include a housing in which there is mounted for rotation at least one cylindrical brush which contacts the surface being swept, picks up dirt from said surface as the brush is being rotated about its axis, and transports the picked-up dirt in a path for deposition in a dirt-collecting receptacle or a plurality of such receptacles.

It has been proposed in the conventional devices of this type to define the dirt-collecting receptacles by portions of the housing itself. For example, it has been proposed to specially manufacture a housing to include a top wall, or a bottom wall, or a side wall which, either singly or together, will cooperate with additional walls of a separate tray to form a completely-enclosed dirt-collecting enclosure. However, the manufacture of such housings is extremely complicated and expensive because of the required precise shaping needed to fit the various walls of the housing to the walls of the separate tray. Furthermore, the dirt-discharging operation of such receptacles is rather cumbersome and difficult to accomplish.

SUMMARY OF THE INVENTION

Accordingly, it is a general object of the present invention to avoid the above-mentioned disadvantages.

More particularly, it is an object of the present invention to provide a sweeping device of the type here under consideration which is not possessed of the disadvantages of the prior-art sweeping devices.

An additional object of the present invention is to provide a carpet-sweeping device which is simple in construction, convenient to operate and also reliable.

It is a concomitant object of the present invention to so construct the sweeping device that the dirt-collecting receptacle or receptacles thereof can be emptied of the dirt accumulated therein in an easy and simple manner.

It is a further object of the present invention to simplify the manufacture of the carpet sweeper housing so that expensive fitting of various walls are no longer required.

In keeping with these objects and others which will become apparent hereinafter, one feature of the present invention resides, briefly stated, in a device for sweeping surfaces, particularly carpets and the like, which comprises a housing, and at least one brush mounted on the housing for rotation about an axis. The brush is rotated about this axis so as to contact a surface to be swept during movement of the device over such surface by a pair of rollers which are in motion-transmitting relationship with the brush. At least one dirt-collecting receptacle having a plurality of walls bounding all sides of an opening is pivotally mounted on the housing for movement between a filling position in which said walls and said opening are respectively located about and in a path in which any dirt picked up by the brush from the surface being swept travels for deposition of dirt into the receptacle, and a discharging position in which the opening is located out of the path for discharging deposited dirt from the receptacle.

In accordance with the invention, the housing need no longer be manufactured with specially constructed walls which are formed with precise tolerances so as to conform with additional walls of a separate dirt-collecting tray. The dirt-collecting receptacle of the present invention is provided with its own top, bottom, side and rear walls; it need no longer depend upon additional walls of the housing to enclose all of the sides bounding an opening. This makes the manufacture of the housing particularly inexpensive and practical.

Moreover, this feature obviates the prior art drawback of having a certain amount of the dirt entering into the dirt-collecting tray escaping from the same through cracks or gaps defined between the walls of the tray and the walls of the housing. The only access between the interior and the exterior of the dirt-collecting receptacle of the invention is through the opening which faces the rotary brush when the receptacle is mounted and assumes its filling position.

In accordance with another aspect of the invention, a guiding wall is located at the opening on the bottom wall of a dirt-collecting receptacle. This guiding wall is inclined, as considered in direction away from the bottom wall, towards the rear wall of the receptacle so as to help guide incoming dirt towards the interior of the receptacle. In addition, the angle of inclination of the guiding wall is so selected that the guiding wall prevents any dirt already deposited in the interior of the receptacle from undesirably escaping towards the exterior of the receptacle.

Another feature of the invention is to form the bottom wall of a dirt-collecting receptacle with an arcuate portion. When a receptacle is pivoted towards the discharging position, this arcuate portion assists in permitting the dirt to escape by gravity from the receptacle. Hence, dirt can no longer become entrapped in corners, and instead can easily be discharged from the receptacle.

Still another feature of the invention is to lock the dirt collecting receptacle in its filling position by snap-type action. A marginal or edge portion of a top wall of a receptacle is received in a recess formed by a detent mounted on a resilient tongue and spaced from a housing top wall. Hence, undesired tilting of the container during the sweeping operation is prevented. Advantageously, the housing and the dirt-collecting receptacle are both constructed of resilient synthetic plastic material so as to provide adequate elasticity in order to establish or discontinue the snap-type connection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a partially broken-away view as seen from below of a device in accordance with the present invention; and FIG. 2 is a section taken along the line II—II of FIG. 1.

DESCRIPTION OF THE PREFERRED EMBODIMENTS

FIG. 1 shows the underside of a sweeping device, particularly for sweeping carpets and the like, which is movable generally in a to-and-fro manner over a surface to be swept. The device comprises an I-shaped housing 10 having a middle portion 12 (which corresponds to the vertical bar of the letter I) which extends generally transversely of the direction of advancement of the device over the surface, and a pair of mutually parallel side portions 11 (which correspond to the horizontal bars of the letter I) which are connected at opposite ends of the middle portion 12 and which extend generally along the advancement direction. The side portions 11 bound with the middle portion 12 a pair of recesses 18 on opposite sides of the middle portion 12 each recess 18 having an open top, an open bottom, and an open end remote from the middle portion 12.

A cylindrical brush 14 is mounted on the housing and extends generally lengthwise of the middle portion 12. The brush 14 has at each of its opposite ends a contact roller 14' which is in motion-transmitting frictional contact with support wheels or rollers 13. Two of the rollers 13 are mounted in each side portion 11 on either side of the contact roller 14' for rotating the brush 14 about its longitudinal axis of rotation to thereby cause dirt picked up by the brush 14 from the surface to travel in a path towards at least one of dirt-collecting receptacles 15 which are mounted on either side of the brush 14, i.e. at the front and rear portions of the housing 10 as considered with respect to the advancement direction.

As shown in FIG. 2, each receptacle 15 has a top wall 22, a bottom wall 19, an end wall 29, a pair of side walls 21 between the top and bottom walls, and a guiding wall 20. The walls of the receptacle 15 bound an interior space which can only communicate with the exterior of the receptacle 15 by means of an opening 16. Each receptacle 15 is pivotally mounted at axles or pins 17 on the housing 10 for movement between a filling position in which the walls are 19–22 are located about the path in which the dirt travels and in which the opening 16 is located in said path for deposition of dirt into the receptacle 15, and a discharging position in which the opening 16 is located out of this path for discharging deposited dirt from the receptacle 15. The left-side of FIG. 2 shows the receptacle 15 in its filling position, and the right-side of FIG. 2 shows the receptacle mounted in its discharging position. It will be noted that when a receptacle 15 is in its filling position, its top, bottom and end walls 22, 19, 29 all respectively overlie the open top, bottom and end of the respective recess 18.

Each receptacle 15 extends along the middle portion 12 and the brush 14. Similarly, the opening 16 extends along of the brush 14 so that all dirt picked up by the brush 14 can be deposited into the receptacle 15 through the opening 16.

In order to guide the dirt in its path into the receptacle 15, the guiding wall 20 is provided at the opening 16 and is connected to the bottom wall 19. In a first embodiment of the receptacle 15 illustrated at the right-side of FIG. 2, the entire rectangularly-shaped bottom wall 19 is located in a plane, and the guiding wall 20 is inclined at an acute angle relative to this plane is considered in direction away from the plane, and towards the rear wall 29. In a second embodiment of the receptacle 15 shown at the left-side of FIG. 2, the bottom wall 19 is comprised of a generally-rectangularly shaped portion which is located in a plane, and an arcuate portion 23. In this latter embodiment, the guiding wall 20 is inclined at an acute angle relative to the plane of the rectangularly-shaped portion as considered in direction away from the plane, towards the rear wall 29 and is connected to the arcuate portion 23. It is noted that in the first embodiment, the guiding wall 20 extends towards the interior of the receptacle 15, whereas in the second embodiment, the guiding wall does not extend into the interior of the receptacle 15. The arcuate portion 23 provides for a greatly facilitated discharging of the deposited dirt from the receptacle 15, inasmuch as such dirt will not have any tendency to be trapped in any corners in contrast to the embodiment at the right side of FIG. 2.

Each receptacle 15 is lockable in its filling position by snap-type cooperating elements. A marginal portion 24 is formed at the free edge of top wall 22 at the opening 16 and may advantageously be slightly bent out of the plane of the top wall 22. The middle portion 12 has an upper wall 25 formed with a resilient tongue 26 which extends downwardly of the wall 25. A detent or projecting portion 27 is provided at the free end of the tongue 26, and preferably the detent portion 27 has tapered edges.

In operation, a receptacle 15 is pivoted from the position shown on the right-side of FIG. 2 towards the position shown at the left side of this Figure. The edge 24 will engage the detent 27 and urge the same in direction towards the brush 14 for a distance sufficient to permit the edge 24 to snap into a groove located behind the detent 27 and bounded by the detent 27, the tongue 26, and the upper housing wall 25. The tapered edges on the marginal 24 and on the detent portion 27 facilitate the snap-in operation, as well as the snap-out operation. Preferably, the receptacle 15 and the elements 26, 27 are constituted by resilient synthetic plastic material.

The means for pivoting a receptacle on the housing includes a pair of the pins or axles 17, each pin 17 being mounted at a respective side wall 21 of a receptacle to the housing side portions 11. As shown in FIG. 2 each pin 17 is located approximately centrally between the top wall 22 and the bottom wall 19, as well as being located closer to an end wall 29 than to the opening 16. In order to facilitate manual movement of each receptacle 15 between the aforementioned positions about the pivot axis defined by the pins 17, gripping means or a pair of recessed portions 28 is provided at the top, bottom and rear walls 22, 19, 29 of each receptacle 15.

It will be understood that each of the elements described above, or two or more together, may also find a useful application in other types of constructions differing from the types described above.

While the invention has been illustrated and described as embodied in a carpet sweeper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for sweeping surfaces, particularly carpets and the like, comprising a housing having an open bottom; at least one brush mounted on said housing for rotation about an axis and operative for contacting a surface to be swept during movement of the device over such surface; means for rotating said brush about said axis so that dirt picked up by said brush from the surface being swept travels in a path; at least one dirt-collecting receptacle having an open end portion bounding all sides of an opening; means for pivotally mounting said dirt-collecting receptacle on said housing for movement between a filling position in which said open end portion and said opening are respectively located about and in said path for deposition of dirt in said receptacle, and a discharging position in which said open end portion of said receptacle projects downwardly from said housing through said open bottom thereof so that said opening is located out of said path for discharging deposited dirt from said receptacle; and means for locking said receptacle in said filling position, comprising cooperating locking portions on said housing and said receptacle, respectively.

2. A device as defined in claim 1, wherein said housing has a middle portion extending transversely of the direction of movement of the device over the surface, and side portions at opposite ends of said middle portion and extending along said direction; and wherein said side portions and said middle portion together bound a recess having an open top, said open bottom, and an open end remote from said middle portion; and wherein said receptacle has a top wall, a bottom wall, and an end wall all of which respectively overlie said open top, bottom, and end of said recess when said receptacle is in said filling position.

3. A device as defined in claim 2, wherein said receptacle also has a pair of side walls extending intermediate said top and bottom walls and connected to said end wall so as to bound a closed end opposite said open end; and wherein said brush is elongated lengthwise of said middle portion, and wherein said opening is elongated lengthwise of said brush.

4. A device as defined in claim 3, wherein said bottom wall has a substantially rectangular portion located in a plane; and wherein said dust-collecting receptacle further has a guiding wall at said opening, said guiding wall being connected and extending from said bottom wall at an angle relative to the plane in which said rectangular portion is located; and wherein said guiding, bottom, top and side walls together bound said opening of said receptacle.

5. A device as defined in claim 2, wherein said bottom wall is substantially planar; and further comprising a guiding wall at said opening and being connected to and extending from said bottom wall into the interior of said receptacle towards said end wall at an angle relative to the plane in which said bottom wall is located.

6. A device as defined in claim 2, wherein said bottom wall has a substantially planar portion and an arcuate portion; and further comprising a guiding wall at said opening and being connected to and extending from said arcuate portion away from the interior of said receptacle and also away from said end wall at an angle relative to the plane in which said substantially planar portion is located.

7. A device as defined in claim 2, wherein said rotating means comprises two pairs of rollers, each pair being mounted in a respective one of said side portions of said housing and being in motion-transmitting frictional contact with said brush.

8. A device as defined in claim 1, wherein said means for pivotally mounting said receptacle includes a pair of pins mounted intermediate said receptacle and said housing, each pin having a pivot axis about which said receptacle is pivoted between its filling and discharging positions.

9. A device as defined in claim 8, wherein said receptacle has top and bottom walls spaced from each other, a pair of side walls extending intermediate said top and bottom walls, and an end wall spaced from said opening; and wherein each pin is located in a respective side wall substantially centrally intermediate said top and bottom walls and is also located closer to said end wall then to said opening.

10. A device as defined in claim 1; and further comprising means for gripping said receptacle, including a pair of recessed portions formed in said walls of said receptacle to facilitate manual movement of the latter between said positions.

11. A device for sweeping surfaces, particularly carpets and the like, comprising a housing having a middle portion extending transversely of a direction of movement of the device over a surface to be swept, and side portions at opposite ends of said middle portion and extending along said direction, said side portions and said middle portion together bounding two recesses located at opposite front and rear sides of said middle portion as considered in said direction and each having an open bottom, and an open end remote from said middle portion; at least one brush mounted on said housing intermediate said recesses for rotation about an axis and operative for contacting the surface to be swept during movement of the device thereover; means for rotating said brush about said axis in opposite directions of rotation so that dirt picked up by said brush from the surface being swept travels in one of two paths depending on the direction of rotation of said brush; two dirt-collecting receptacles each having a plurality of walls bounding all sides of an opening and including a top wall, a bottom wall and two side walls, and an end wall; and means for pivotally mounting each one of said dirt-collecting receptacles on said housing in one of said recesses for movement between a filling position in which said top, bottom and side walls and said opening of said one receptacle are respectively located about and in one of said paths for deposition of dirt in said one receptacle and said top, bottom and end walls of said one receptacle respectively overlie said bottom and end of the respective recess, and a discharging position in which said opening of said one receptacle is located out of said one path for discharging deposited dirt from said one receptacle.

12. A device as defined in claim 11; said dirt-collecting receptacles being constituted by synthetic plastic material.

13. A device for sweeping surfaces, particularly carpets and the like, comprising a housing; at least one brush mounted on said housing for rotation about an axis and operative for contacting a surface to be swept during movement of the device over such surface; means for rotating said brush about said axis so that dirt picked up by said brush from the surface being swept travels in a path; at least one dirt-collecting receptacle having a plurality of walls bounding all sides of an opening and including a top wall; means for pivotally mounting said dirt-collecting receptacle on housing for movement between a filling position in which said walls and said opening are respectively located about and in said path for deposition of dirt in said receptacle, and a discharging position in which said opening faces downwardly and is located out of said path for discharging deposited dirt from said receptacle; and means for locking said receptacle with snap-type action in said filling position, including a marginal portion provided on said top wall of said receptacle, and a resilient tongue on said housing and having a detent portion, said detent portion forming with said housing a snap-in groove for cooperatively receiving said marginal portion of said receptacle with snap-type action.

14. A device as defined in claim 13, wherein said marginal portion and said groove both extend in direction transversely of the direction of movement of the device over the surface.

15. A device as defined in claim 13, wherein said marginal portion of said top wall and said tongue are both formed of resilient synthetic plastic material.

* * * * *